United States Patent [19]

Asselman et al.

[11] 4,373,343

[45] Feb. 15, 1983

[54] HOT WATER PRODUCTION APPARATUS UTILIZING A HEAT PUMP

[75] Inventors: George A. A. Asselman, Eindhoven, Netherlands; Albertus P. J. Michels, Laveno Mombello, Italy

[73] Assignee: U.S. Philips Corporation, New York, N.Y.

[21] Appl. No.: 262,258

[22] Filed: May 8, 1981

[30] Foreign Application Priority Data

May 12, 1980 [IT] Italy ..... 21983 A/80

[51] Int. Cl.[3] ..... F25B 27/02

[52] U.S. Cl. ..... 62/238.6; 237/2 B

[58] Field of Search ..... 62/238.6, 119; 165/DIG. 17; 237/2 B

[56] References Cited

U.S. PATENT DOCUMENTS

| | | | |
|---|---|---|---|
| 2,350,348 | 6/1944 | Gaugler | 62/119 |
| 2,375,157 | 5/1945 | Wilkes et al. | 62/238.6 X |
| 3,217,791 | 11/1965 | Long | 62/119 X |
| 3,195,619 | 7/1965 | Tippmann | 62/119 X |
| 4,135,371 | 1/1979 | Kesselring et al. | 62/119 |

FOREIGN PATENT DOCUMENTS

| | | | |
|---|---|---|---|
| 252634 | 4/1963 | Australia | 62/238.6 |
| 1055019 | 4/1959 | Fed. Rep. of Germany | 62/238.6 |
| 2540004 | 3/1977 | Fed. Rep. of Germany | 62/238.6 |
| 821079 | 9/1959 | United Kingdom | 62/238.6 |

*Primary Examiner*—Lloyd L. King

*Attorney, Agent, or Firm*—Thomas A. Briody; William J. Streeter; Rolf E. Schneider

[57] ABSTRACT

There is provided a hot water production apparatus comprising a container for water and a heat pump including a motor-compressor unit disposed in a sealed casing containing the heating fluid. The heat generated in the motor-compressor unit is transferred to the water by way of a heat pipe insulated over its portion extending between the water container and the sealed casing. The heat pipe is charged with an inert gas and an operating medium which in the range of 20° to 100° C. has a vapor pressure such that, at a temperature within this range, the front between the inert gas and the operating medium is situated in the portion of the heat pipe present in the water container.

4 Claims, 2 Drawing Figures

HOT WATER PRODUCTION APPARATUS UTILIZING A HEAT PUMP

Figure 1:
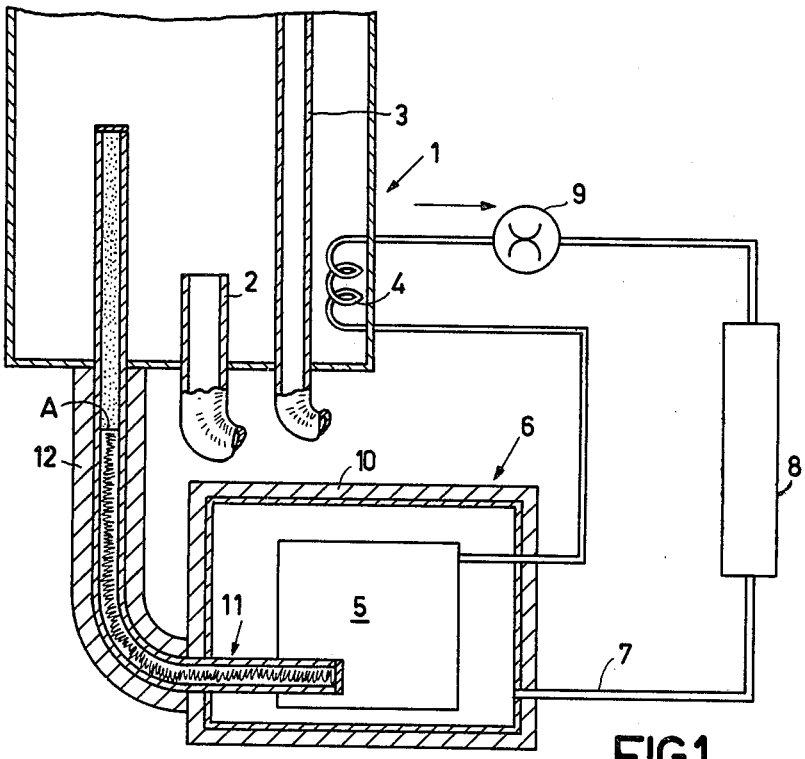

This invention relates to hot water production apparatus utilizing a heat pump as the heat generator.

Hot water production apparatus of the specified type comprises a container for the water to be heated, and a heat pump formed from at least one condenser section associated with the water container in such a manner that the heating fluid, which circulates through the pump, gives up its heat of condensation to the water, thus heating it, at least one capillary or other restriction device, an evaporator section in which the heating fluid absorbs heat from the environment in which said evaporator section is disposed, and a motor-compressor unit contained in a sealed casing and compressing the heating fluid, which it then feeds to the condenser section. An apparatus of this type is for example described in application Ser. No. 75,478 filed Sept. 14, 1979, now U.S. Pat. No. 4,290,275.

During its operation, the motor-compressor unit produces heat which is dispersed into the environment through the walls of the sealed container casing in which it is contained. In order to utilize this heat (which is certainly not negligible) for heating the water, it has already been proposed to equip the heat pump with two condenser sections, both disposed in contact with the water to be heated and in series with each other such that the heating fluid, after cooling in the first section, returns to the motor-compressor unit (where it cools the lubricating oil which collects in the bottom of the casing) to then flow to the second section where further heat is given up to the water. However, this design has the drawback that when the temperature of the water to be heated is still low, the motor-compressor unit operates at a temperature which is so low that adequate lubrication of its mechanical parts is not attained, with consequent danger of seizing. This is because, the heating fluid in the second condenser section is very cold and consequently considerably reduces the oil viscosity.

A further attempt to utilize the heat generated by the motor-compressor unit for heating the water in such an apparatus is described in U.S. Pat. No. 2,516,094. In such case the motor-compressor unit is enclosed in a sump surrounded partly by the water to be heated and partly by thermal insulation. An electric motor is disposed in this sump, and operates a fan which by agitating the air in the sump improves the heat transfer conditions between the motor-compressor unit and the water. Apart from the fact that an electric motor is present consuming energy and operating under poor conditions because it is enclosed in the sump, in such apparatus the motor-compressor unit operates at an excessively high temperature when the water temperature is high or at too low a temperature when the water is still cold.

The object of the present invention is to improve hot water production apparatus utilizing a heat pump for the supply of heat, such that the heat produced in the motor-compressor unit is used for heating the water but without the lubrication of the mechanical parts of the motor-compressor unit suffering because of this when the water to be heated is at a low temperature, for example, between 8° and 15° C.

According to the invention, this object is attained by causing the heat generated in the motor-compressor unit to be transferred to the water by way of a heat pipe or tube which is at least partly insulated and is arranged between a point within the sealed casing and a point within the water container or reservoir and which is charged with an inert gas and an operating medium, which has a vapour pressure within the range of 20° to 100° C. whereby, at a temperature within such range the front between the inert gas and the operating medium is situated in the portion of the heat tube which is present in the water container.

Heat tubes, in the form of closed-end tubes containing a certain gaseous or liquid charge, are known to be particularly simple and effective devices which enable the temperature of an object to be kept constant by dissipating from it the heat which is produced therein.

However, the invention does not consist in the pure and simple application of a heat tube for transferring the waste heat of the motor-compressor unit from the latter to the water to be heated, but rather in the use of a specific charge such as to enable heat transfer to take place when the temperature of the heating fluid in the motor-compressor sealed casing is sufficiently high to ensure that the lubricating oil temperature is sufficient to provide adequate lubrication of the mechanical parts of the motor-compressor unit.

In order for the waste heat generated in the motor-compressor unit not to be dispersed to the outside environment through the sealed casing which contains it, the invention provides for said casing to be thermally insulated using conventional methods.

The charge in the heat tube can be formed by any medium which is suitable for use as a heating fluid in heat pumps (or, the same thing, in compressor refrigeration circuits), for example, a halogenated hydrocarbon such as dichlorodifluoromethane. It is however possible to use water or another medium which at a temperature of 20° to 100° C. has a vapour pressure sufficiently high to act as the operating medium in the heat tube. The inert gas used can be nitrogen, carbon dioxide or helium.

Figure 2:
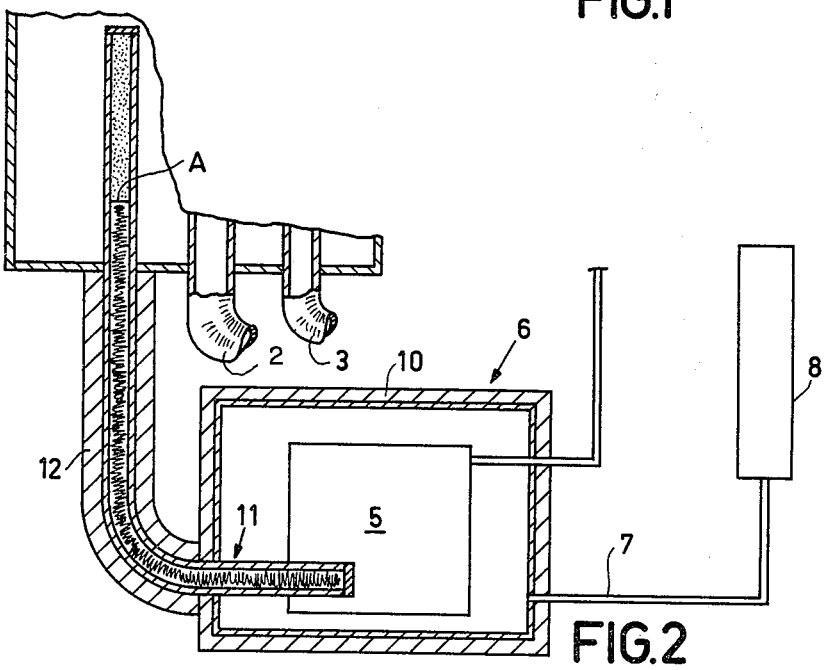

The invention will now be described in detail with reference to the accompanying drawings, in which:

FIG. 1 is a diagrammatic section through the hot water production apparatus of the invention on starting the heat pump, and FIG. 2 is a partly sectional view thereof when the motor-compressor unit has reached its operating temperature.

Reference numeral 1 indicates the container for the water mass to be heated. The cold water is fed through a pipe 2 which opens into the bottom of the container 1, while hot water is taken from the top by way of the pipe 3.

The water mass in the container 1 is heated by the condenser 4 of a heat pump, the condenser being shown in the drawing in the form of a coil, but it can be of any suitable other shape.

The condenser 4 is traversed by the heating fluid, for example a halogenated hydrocarbon of the type used in compressor refrigeration circuits, such as Freon 12, which is circulated by a motor-compressor unit 5 which is disposed in known manner inside a sealed casing 6 in a bath formed by the heating fluid mixed with lubricating oil. The heating fluid enters the casing 6 through a return pipe 7 which is connected to the outlet of an evaporator 8 in the form of a heat exchanger, the inlet of which is connected to the outlet of the condenser 4 through a throttle valve 9.

The sealed casing 6 is provided with a heat-insulating covering 10, the purpose of which is to prevent the heat generated in the motor-compressor unit 5 from becoming dispersed towards the environment.

According to the invention, in order to utilize the heat produced in the motor-compressor unit 5 for heating the water without the mechanical parts of this unit suffering inadequate lubrication on start-up due to excessive cooling, this waste heat is transferred to the water by means of a heat pipe or tube 11, for example, of copper, the terminal portions of which extend respectively into the water in the container 1, preferably into its lower part, and into the underlying casing 6 which encloses the motor-compressor unit 5. The intermediate portion of the heat tube 11 between the casing 6 and the container 1 is provided with an insulating covering 12, for example in the form of an insulating sleeve of rock wool. The heat tube 11 is charged with an inert gas, for example nitrogen, helium or carbon dioxide, and an operating medium used for heat transfer and having a vapour pressure over the temperature range of 20° to 100° C. which is sufficiently high to ensure that the front A between the inert gas and the operating medium reaches the terminal portion of the heat tube which penetrates into the container 1, with the consequence that heat can pass from the casing 6 to the water in the container 1 only when a temperature in the aforesaid range is reached. Suitable operating mediums include the actual heating fluid itself (i.e. a halogenated hydrocarbon such as dichlorodifluoromethane), water or ammonia.

By using a heat tube charge in the manner indicated, the heat generated in the compressor can be transferred to the water to be heated without the motor-compressor unit reaching a temperature which is so low that its lubrication may be prejudiced.

When the temperature of the water to be heated is low, for example, around 10° C., and the motor-compressor unit has just been started so that its temperature is substantially equal to the ambient temperature, for example, around 15° C., at this low temperature the front A will not yet be situated within the container 1. Since the casing 6 (containing the motor-compressor unit 5) and the intermediate portion of the heat tube 11 are insulated, no heat is lost to the outside from said casing, so that the temperature of the motor-compressor unit increases. As this temperature and thus the pressure inside the heat tube 11 increase, the front A advances and (see FIG. 2) reaches the inside of the container 1, i.e. the zone containing the water to be heated, so that heat is transferred to the water through the wall of the heat tube 11. The position of the front A stabilizes when the motor-compressor unit reaches its operating temperature and the heat given up is equal to the heat generated.

What is claimed is:

1. Hot water production apparatus comprising a container for water; a heat pump including a motor-compressor unit, a condenser and an evaporator connected in a closed circuit containing a heating fluid, said condenser being associated in heat-exchange relationship with the water in said container, said motor-compressor unit being disposed within a sealed casing in a bath of said heating fluid; and a heat pipe extending between a point within the water container and a point within the sealed casing and insulated over its portion between said water container and said sealed casing, said heat pipe being charged with an inert gas and an operating medium that in the range of 20° to 100° C. has a vapour pressure such that, at a temperature within said range, the front between the inert gas and the operating medium is situated in the portion of the heat pipe present in the water container.

2. Apparatus according to claim 1, in which the inert gas is nitrogen, carbon dioxide or helium.

3. Apparatus according to claim 1 or 2, in which the operating medium is the same as the heating fluid, water or ammonia.

4. Apparatus according to claim 3, in which the sealed casing is thermally insulated.

* * * * *